US010486233B2

(12) United States Patent
Liu et al.

(10) Patent No.: US 10,486,233 B2
(45) Date of Patent: Nov. 26, 2019

(54) METHOD FOR ELIMINATING HOLLOW DEFECT IN ATOMIZED ALLOY POWDER

(71) Applicant: CENTRAL SOUTH UNIVERSITY, Hunan (CN)

(72) Inventors: Zuming Liu, Hunan (CN); Pengfei Su, Hunan (CN); Boyun Huang, Hunan (CN); Qinglong Duan, Hunan (CN); Mengmei Ma, Hunan (CN); Yang Guo, Hunan (CN); Shiqi Chen, Hunan (CN)

(73) Assignee: CENTRAL SOUTH UNIVERSITY, Hunan (CN)

( * ) Notice: Subject to any disclaimer, the term of this patent is extended or adjusted under 35 U.S.C. 154(b) by 148 days.

(21) Appl. No.: 15/556,619

(22) PCT Filed: Mar. 8, 2016

(86) PCT No.: PCT/CN2016/075835

§ 371 (c)(1),
(2) Date: Sep. 8, 2017

(87) PCT Pub. No.: WO2016/141870

PCT Pub. Date: Sep. 15, 2016

(65) Prior Publication Data

US 2018/0056398 A1 Mar. 1, 2018

(30) Foreign Application Priority Data

Mar. 9, 2015 (CN) ..... 2015 1 0103202
Dec. 3, 2015 (CN) ..... 2015 1 0884690

(51) Int. Cl.
*B02C 17/20* (2006.01)
*B22F 9/04* (2006.01)
(Continued)

(52) U.S. Cl.
CPC ..... *B22F 9/04* (2013.01); *B02C 17/20* (2013.01); *B02C 25/00* (2013.01); *C22C 19/056* (2013.01);
(Continued)

(58) Field of Classification Search
None
See application file for complete search history.

(56) References Cited

U.S. PATENT DOCUMENTS 6,723,278 B1 * 4/2004 Lu ..... B22F 3/1055 419/46
2004/0042922 A1 3/2004 Rasouli et al.
(Continued)

FOREIGN PATENT DOCUMENTS

CN 1358593 7/2002
CN 103433480 12/2013
(Continued)

OTHER PUBLICATIONS

Translation of CN 103433480 (originally published Dec. 11, 2013) from Espacenet.*
(Continued)

*Primary Examiner* — George Wyszomierski
(74) *Attorney, Agent, or Firm* — JCIPRNET

(57) ABSTRACT

The invention relates to a method for eliminating hollow defects in atomized superalloy powder, and pertains to the field of powder metallurgy materials. A ball-milling processing is conducted on the atomized alloy powder to eliminate the hollow defect, obtain solid powder and increase powder utilization efficiency. By controlling mill ball diameters, mass ratio of mill balls with different diameters, mass ratio of ball to powder and ball milling time, a multi-directional impact on the powder is achieved, thereby control powder shape and obtain solid spherical powder. The
(Continued)

invention eliminates powder hollow defect by using ball milling process and equipment. This invention with high powder utilization efficiency, short ball milling time and simple operating process, can be used for large-scale preparation and application.

10 Claims, 1 Drawing Sheet

(51) Int. Cl.
*B02C 25/00* (2006.01)
*C22C 19/05* (2006.01)
*C22C 1/04* (2006.01)

(52) U.S. Cl.
CPC ..... *B22F 2009/043* (2013.01); *B22F 2998/10* (2013.01); *B22F 2999/00* (2013.01); *C22C 1/0433* (2013.01)

(56) References Cited

U.S. PATENT DOCUMENTS

2013/0084204 A1* 4/2013 Wang ..... B22F 1/025 419/23
2014/0255240 A1* 9/2014 Fang ..... B22F 3/101 419/29
2016/0307679 A1* 10/2016 Taheri ..... H02K 1/02
2017/0216919 A1* 8/2017 Liu ..... B22F 3/12

FOREIGN PATENT DOCUMENTS

CN 103551568 2/2014
CN 105344436 2/2016
JP 2001073012 3/2001

OTHER PUBLICATIONS

"International Search Report (Form PCT/ISA/210)", dated Jun. 15, 2016, with English translation thereof, pp. 1-4.

* cited by examiner

METHOD FOR ELIMINATING HOLLOW DEFECT IN ATOMIZED ALLOY POWDER

CROSS-REFERENCE TO RELATED APPLICATION

This application is a 371 application of an International PCT application serial no. PCT/CN2016/075835, filed on Mar. 8, 2016, which claims the priority benefits of China Application No. 201510103202.3, filed on Mar. 9, 2015, and China Application No. 201510884690.6, filed on Dec. 3, 2015. The entirety of each of the above-mentioned patent applications is hereby incorporated by reference herein and made a part of this specification.

FIELD OF THE INVENTION

The present invention relates to a method for eliminating hollow defects in atomized superalloy powder, and pertains to the field of powder metallurgy materials.

BACKGROUND OF THE INVENTION

The gas atomization of melting alloy is a main method for superalloy powder preparation. However, a main problem raised in such a method is that a large amount of prepared powder may contain closed pores filled with atomizing gas, which is defined as hollow powder. The hollow defects in power is completely sealed, which is difficult to be eliminated in subsequent powder-forming process. Thus, the hollow defects will remain in the materials and finally form pores. In the meanwhile, residual gas sealed in hollow defects will expand during subsequent heat-treatment and service. All of those factors lead to the formation of heat-induced pore, or heat-induced crack, which severely deteriorates materials mechanical properties, especially for powder metallurgy superalloy. Therefore, hollow powder is one of the main sources of those defects, and severely deteriorates superalloy mechanical properties.

Currently, among superalloy powder prepared through gas atomization process, the ratio of hollow powder to solid powder in those of particle size over 75 μm (200 meshes) is relative high, and ratio of hollow powder to solid powder in small particles is relative low. A method of sieving powder has been applied to remove hollow powder for a long time. In countries such as America and Russia, atomized powder of which particle size is less than or equal to 53 μm (−270 meshes) or 45 μm (−325 meshes) is generally used to prepare superalloy to reduce adverse impact of the powder hollow defect on alloy mechanical properties, but it will cause lower powder utilization efficiency and higher cost. By using the sieving method, large-size hollow powder can be removed, but hollow powder can also generated from undersize particles, which makes the eliminating process incomplete. Moreover, sieving method to remove hollow powder usually suffers low powder utilization efficiency, serious waste and increased cost of alloy preparation.

With regard to the problem of hollow defects in atomized powder during powder preparation, controlling atomization process parameters is a main method to reduce the hollow ratio of powder. For powder preparation through plasma rotating electrode process (PREP), controlling the rotating speed of electrode bar and pressure of atomized gas are mainly methods to reduce the hollow ratio of powder. When the rotating speed of electrode bar is reduced, the quantity of hollow powder is also reduced, but the content ratio of large-size powder is increased, yield of fines is low, and the hollow size is correspondingly enlarged. When the rotating speed of electrode bar is increased, the quantity of hollow powder is increased, but the yield of fines is high. When the atomized gas pressure is reduced, the quantity of hollow powder is also reduced, but the content ratio of large-size powder is high, and the yield of fines is low. With reducing atomized gas pressure, the melt solidification rate is also reduced. Consequently, the microstructure of solidified powder becomes bulky. For superalloy powder fabricated by argon atomization (AA), detailed process for eliminating powder hollow defects has not been reported, and features of gas atomization technique cause that controlling parameters during the atomization process can only reduce hollow powder ratio, not completely eliminate the powder hollow defect.

So far the method for eliminating hollow defects in atomized powder has not been reported.

SUMMARY OF THE INVENTION

The present invention provides a method for eliminating hollow defects in atomized superalloy powder.

A method for eliminating hollow defects in atomized superalloy powder is provided, through which mechanical ball-milling is conducted on the atomized superalloy powder to eliminate hollow defects; and the mechanical ball-milling can be planetary ball mill, stirring ball mill, or drum-type ball mill.

At least three kinds of mill balls with different diameters are used in the mechanical ball-milling process, and all of mill balls are combined according to mass ratio.

Four kinds of mill balls with different diameters are used in the mechanical ball-milling process with the mill ball diameters of 9-11 mm, 7-9 mm, 5-7 mm, and 4-6 mm respectively, and all of mill balls are combined according to mass ratio of 1:2.5-3.5:0.5-1.5:4-6 in descending order of the diameters.

The four diameters of mill balls are 10 mm, 8 mm, 6 mm, and 5 mm respectively, which are combined according to mass ratio of 1:3:1:5 in descending order of the diameters.

The atomized alloy powder is loaded into a ball-milling tank with a mass ratio of ball to powder as (8~12):1, and the ball milling is performed in the planetary ball mill with the ball milling rotating speed of 250~350 r/min and ball milling time of 1~4 h under the protection of inert gas.

The atomized alloy powder is loaded into a ball-milling tank with a mass ratio of ball to powder as (8~15):1, and the ball milling is performed in the stirring ball mill with the ball milling rotating speed of 60~150 r/min and ball milling time of 2~6 h under the protection of inert gas.

Advantages of the Present Invention

According to the present invention, mechanical ball-milling process is performed on atomized alloy powder for a short time to make alloy powder deform, and hollow powder will collapse or fragment. In the meanwhile, the gas sealed in the hollow powder is released. As a result, the powder hollow defect is eliminated, and finally completely solid powder is achieved.

According to the present invention, powder deformation determined by ball-milling energy and the ball-milling time is controllable. Ball-milling energy is controllable by adjusting the ratio of mill balls with different diameters and the mass ratio of ball to powder. A multi-directional impact on the powder by controlling the ratio of mill balls with different diameters is to obtain solid spherical powder.

By the ball-milling processing, unqualified large-particle-size hollow powder removed by sieving becomes qualified powder, and hollow defects and solidified pores in small-particle-size powder are also eliminated.

The solidification microstructure of atomized powder is effectively improved through the deformation of atomized powder by ball milling.

The present invention applies ball milling process to atomized powder by controlling mill ball diameters, mass ratio of mill balls with different diameters and mass ratio of ball to powder, and the ball-milling time to perform a multi-directional impact on the powder, thereby control powder shape and obtain solid spherical powder. It is to get the hollow powder problem settled, which have beset the powder metallurgy field for a long time. This invention with high powder utilization efficiency of above 85%, short ball milling time and simple operating process, can be used for large-scale preparation and application.

Figure 1:
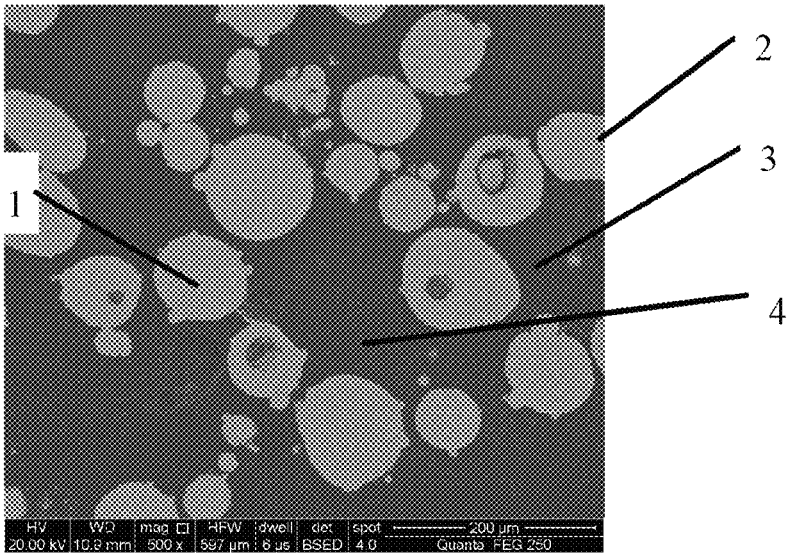
FIG. 1 is a scanning electron microscope (SEM) image of cross-section of gas-atomized nickel-base superalloy powder according to embodiment 1 of the present invention.

From the SEM observation in FIG. 1, some gas-atomized powder in embodiment 1 exhibits obvious hollow defects. For powder particle sample 1, 2, 3, and 4 in FIG. 1, the powder hollow defects are obvious, and the powder particle sizes show no difference compared to other powder in a same field of view.

Figure 2:
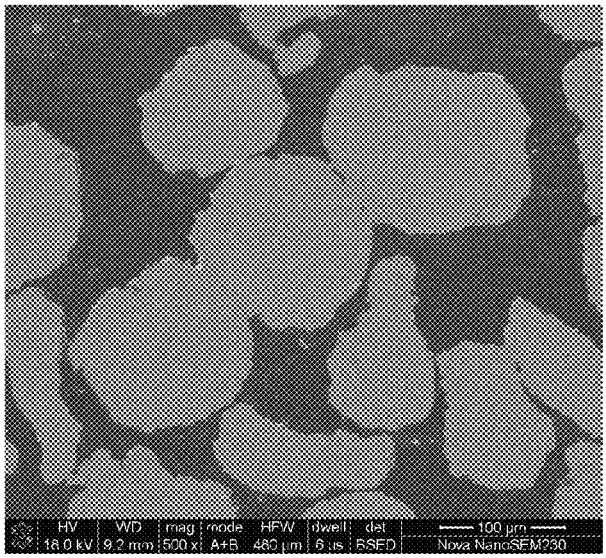
FIG. 2 is a SEM image of cross-section of mechanical ball-milling gas-atomized nickel-base superalloy powder according to embodiment 1 of the present invention.

From the SEM observation in FIG. 2, no hollow defects are observed in gas-atomized powder by mechanical ball-milling in Embodiment 1. That is, the powder hollow defects are eliminated, and the powder sphericity is preferably kept.

DESCRIPTION OF THE EMBODIMENTS

The following further describes the technical solution to the present invention with reference to specific embodiments and drawings.

Embodiment 1

A gas-atomized nickel-base superalloy powder (the composition is Ni-20.6Co-13Cr-3.8Mo-2.1W-3.4Al-3.9Ti-2.4Ta-0.9Nb (wt. %)) is loaded into a ball milling tank with a ball to powder mass ratio as 8:1. Mill balls with different diameters of 10 mm, 8 mm, 6 mm, and 5 mm are used, and all of mill balls are combined according to a mass ratio of 1:3:1:5. The process is conducted under an argon gas as atmosphere as a protective gas after vacuumed. Ball milling is performed in a planetary ball mill with a ball-milling rotating speed of 250 r/min and ball-milling time of 3 h to obtain nickel-base superalloy powder without hollow defect.

FIG. 1 is a SEM image of cross-section of gas-atomized nickel-base superalloy powder before ball-milling processing in this embodiment. In FIG. 1, significant hollow defects can be observed in some powders, and particle sizes of those powder presents no difference compared to other powder in a same field of view. FIG. 2 is a SEM image of cross-section of mechanical ball milling powder in this embodiment, and no hollow powder is observed. It indicates that mechanical ball-milling can eliminate powder hollow defect, and obtain completely solid powder.

Embodiment 2

A Gas-atomized nickel-base superalloy powder (the composition is Ni-20.6Co-13Cr-3.8Mo-2.1W-3.4Al-3.9Ti-2.4Ta-0.9Nb (wt. %)) is loaded into a ball milling tank with a mass ratio of ball to powder as 10:1. Mill balls with different diameters of 9 mm, 7 mm, 5 mm, and 4 mm are used, and all of mill balls are combined according to a mass ratio of 1:3.5:1.5:6. The process is conducted under an argon gas as atmosphere as a protective gas after vacuumed. Ball milling is performed in a planetary ball mill with a ball-milling rotating speed of 300 r/min, and ball-milling time of 2 h to obtain nickel-base superalloy powder without hollow defect.

Embodiment 3

A gas-atomized nickel-base superalloy powder (the composition is Ni-20.6Co-13Cr-3.8Mo-2.1W-3.4Al-3.9Ti-2.4Ta-0.9Nb (wt. %)) is loaded into a ball milling tank with a mass ratio of ball to powder as 10:1. Mill balls with different diameters of 11 mm, 9 mm, 7 mm, and 6 mm are used, and all of mill balls are combined according to a mass ratio of 1:2.5:0.5:4. The process is conducted under an argon gas as atmosphere as a protective gas after vacuumed. Ball milling is performed in a stirring ball mill with a ball-milling rotating speed of 100 r/min, and ball milling time of 3 h to obtain nickel-base superalloy powder without hollow defect.

What is claimed is:

1. A method for eliminating hollow defect in atomized alloy powder, wherein the method comprises mechanical ball milling on the atomized alloy powder to eliminate the powder hollow defect, wherein four kinds of mill balls characterized by having different diameters are used in the mechanical ball milling process, the four diameters of the mill balls are in ranges of 9-11 mm, 7-9 mm, 5-7 mm, and 4-6 mm respectively, and all of the mill balls are combined according to mass ratio of 1:2.5-3.5:0.5-1.5:4-6 in descending order of the diameters.

2. The method for eliminating the hollow defect in atomized alloy powder according to claim 1, wherein the ball milling is under the protection of an inert gas.

3. The method for eliminating the hollow defect in atomized alloy powder according to claim 2, wherein the mechanical ball milling is carried out in any one of a planetary ball mill, stirring ball mill, or drum-type ball mill.

4. The method for eliminating the hollow defect in atomized alloy powder according to claim 3, wherein the atomized alloy powder is loaded into a ball milling tank with a mass ratio of the balls to powder as (8~12):1, and the ball milling is performed in the planetary ball mill with a ball mill rotating speed of 250~350 r/min and ball milling time of 1~4 h under the protection of an inert gas.

5. The method for eliminating the hollow defect in atomized alloy powder according to claim 3, wherein the atomized alloy powder is loaded into a ball milling tank with a mass ratio of the balls to powder mass ratio is (8~15):1, and the ball milling is performed in the stirring ball mill with a ball mill rotating speed of 60~150 r/min and ball milling time of 2~6 h under the protection of an inert gas.

6. The method for eliminating the hollow defect in atomized alloy powder according to claim 1, wherein the four diameters of the mill balls are 10 mm, 8 mm, 6 mm, and 5 mm respectively, which are combined according to mass ratio of 1:3:1:5 in descending order of the diameters.

7. The method for eliminating the hollow defect in atomized alloy powder according to claim 6, wherein the atomized alloy powder is loaded into a ball milling tank with the balls to powder mass ratio is (8~12):1, the ball milling is performed in the planetary ball mill with a ball mill rotating speed of 250~350 r/min, and ball milling time of 1~4 h under the protection of an inert gas.

8. The method for eliminating the hollow defect in atomized alloy powder according to claim 6, wherein the atomized alloy powder is loaded into a ball milling tank with the balls to powder mass ratio of (8~15):1, the ball milling is performed in the stirring ball mill with a ball mill rotating speed of 60~150 r/min, and ball milling time of 2~6 h under the protection of an inert gas.

9. The method for eliminating the hollow defect in atomized alloy powder according to claim 1, wherein the atomized alloy powder is loaded into a ball milling tank with the balls to powder mass ratio of (8~12):1, the ball milling is performed in the planetary ball mill with a ball mill rotating speed of 250~350 r/min and ball milling time of 1~4 h under the protection of an inert gas.

10. The method for eliminating the hollow defect in atomized alloy powder according to claim 1, wherein the atomized alloy powder is loaded into a ball milling tank with the balls to powder mass ratio of (8~15):1, the ball milling is performed in the stirring ball mill with a ball mill rotating speed of 60~150 r/min, and ball milling time of 2~6 h under the protection of an inert gas.

* * * * *